US010808485B2

(12) United States Patent
Phielipeit-Spiess et al.

(10) Patent No.: US 10,808,485 B2
(45) Date of Patent: Oct. 20, 2020

(54) SUBSEA ELECTRIC ACTUATOR SYSTEM

(71) Applicant: ONESUBSEA IP UK LIMITED, London (GB)

(72) Inventors: Volker Phielipeit-Spiess, Celle (DE); Carsten Mahler, Celle (DE); Markus Glaser, Huttlingen (DE)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 16/083,190

(22) PCT Filed: Mar. 10, 2017

(86) PCT No.: PCT/EP2017/055686
§ 371 (c)(1),
(2) Date: Sep. 7, 2018

(87) PCT Pub. No.: WO2017/153580
PCT Pub. Date: Sep. 14, 2017

(65) Prior Publication Data

US 2019/0085651 A1 Mar. 21, 2019

(30) Foreign Application Priority Data

Mar. 11, 2016 (EP) ..... 16159823

(51) Int. Cl.
*E21B 33/035* (2006.01)
*E21B 33/038* (2006.01)
(Continued)

(52) U.S. Cl.
CPC ..... *E21B 33/0385* (2013.01); *E21B 33/0355* (2013.01); *E21B 34/04* (2013.01); *E21B 41/04* (2013.01)

(58) Field of Classification Search
CPC .. E21B 33/0355; E21B 33/0385; E21B 34/04; E21B 41/04
See application file for complete search history.

(56) References Cited

U.S. PATENT DOCUMENTS 6,188,327 B1 * 2/2001 Cousins ..... E21B 33/0355 340/853.1
6,257,549 B1 7/2001 Hopper
(Continued)

FOREIGN PATENT DOCUMENTS

EP 1070573 A1 1/2001
EP 2965709 A1 1/2016
(Continued)

OTHER PUBLICATIONS

International Search Report and Written Opinion issued in International Patent Appl. No. PCT/EP2017/055686 dated Jun. 28, 2017; 13 pages.

*Primary Examiner* — Matthew R Buck
(74) *Attorney, Agent, or Firm* — Helene Raybaud

(57) ABSTRACT

A technique facilitates coupling of an electrical actuator (20) with a subsea host (22). Effectively, mechanical and electrical connections are both formed during movement of the electrical actuator into engagement with the host. The electrical actuator is moved to a desired host location, and then the electrical actuator is guided into mechanical engagement with the host. During movement of the electrical actuator into mechanical engagement, a drive member (60) and at least one electrical connector (56, 58) of the actuator are operatively coupled with corresponding features of the host, thus enabling engagement of the actuator and host with a simple installation motion.

19 Claims, 2 Drawing Sheets

(51) Int. Cl.
*E21B 34/04* (2006.01)
*E21B 41/04* (2006.01)

(56) References Cited

U.S. PATENT DOCUMENTS 6,595,487 B2 * 7/2003 Johansen ..... F16K 31/04 251/129.04
6,644,410 B1 11/2003 Lindsey-Curran et al.
7,216,714 B2 5/2007 Reynolds
7,216,715 B2 5/2007 Reynolds
7,222,674 B2 5/2007 Reynolds
7,690,433 B2 4/2010 Reynolds
8,281,863 B2 * 10/2012 Voss ..... F16K 3/0254 166/351
8,286,935 B2 * 10/2012 White ..... E21B 34/04 251/65
8,327,875 B2 * 12/2012 Grace ..... E21B 33/076 137/487.5
8,789,606 B1 * 7/2014 Lugo ..... E21B 33/064 166/250.15
9,624,753 B2 * 4/2017 Stinessen ..... E21B 33/0385
9,920,852 B2 * 3/2018 Garrone ..... F16K 31/047
9,988,129 B2 * 6/2018 Jamieson ..... B63G 8/001
10,107,058 B2 * 10/2018 Misuraca ..... E21B 33/035
2008/0264646 A1 * 10/2008 Sten-Halvorsen ..... E21B 34/04 166/360
2014/0048274 A1 2/2014 Reynolds et al.
2014/0340852 A1 11/2014 Carter
2016/0218461 A1 * 7/2016 Petie ..... H01R 13/523

FOREIGN PATENT DOCUMENTS

WO 2004065068 A1 8/2004
WO 2014184558 A1 11/2014

* cited by examiner

SUBSEA ELECTRIC ACTUATOR SYSTEM

BACKGROUND

Following discovery of a desired subterranean resource, e.g. oil, natural gas, or other desired subterranean resources, well drilling and production systems often are employed to access and extract the resource or resources. During the resource extraction process, the flowrate of resources extracted from the well may be regulated using flow control devices such as valves. Generally, the flow control devices are controlled using an actuator. For example, a choke valve may include a stem which is stroked along a linear path to transition the choke valve between an open position and a closed position. The actuator is used to control the position of the stem and thus the flow position of the choke valve. Various other types of valves, e.g. gate valves or ball valves, also may be controlled by actuators to thus control fluid flow along a flow line, e.g. a production line or an injection line.

In some operations, subsea actuators have been constructed for coupling with a subsea host. However, coupling of such subsea actuators to the host is a relatively complicated procedure in which mechanical connections are initially formed between the actuator and the device, e.g. valve, being actuated in the subsea host. Then, electrical connectors are coupled to the actuator to enable flow of electrical signals, e.g. power and/or data signals. The relatively complicated procedure of mechanical coupling and separate electrical coupling renders the initial connection, as well as replacement of the subsea actuator, time-consuming and sometimes problematic.

SUMMARY

In general, the present disclosure provides a system and methodology for coupling an actuator, e.g. a subsea actuator, with a host, e.g. a subsea host, in which mechanical and electrical connections are both formed during movement of the actuator into engagement with the host. For example, a subsea actuator may be moved to a desired subsea host location, and then the subsea actuator may be guided into initial mechanical engagement with the subsea host. During movement of the subsea actuator into full mechanical engagement, a drive member and at least one electrical connector of the actuator are operatively coupled with corresponding features of the subsea host, thus enabling engagement of the subsea actuator and subsea host with a simple installation motion.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
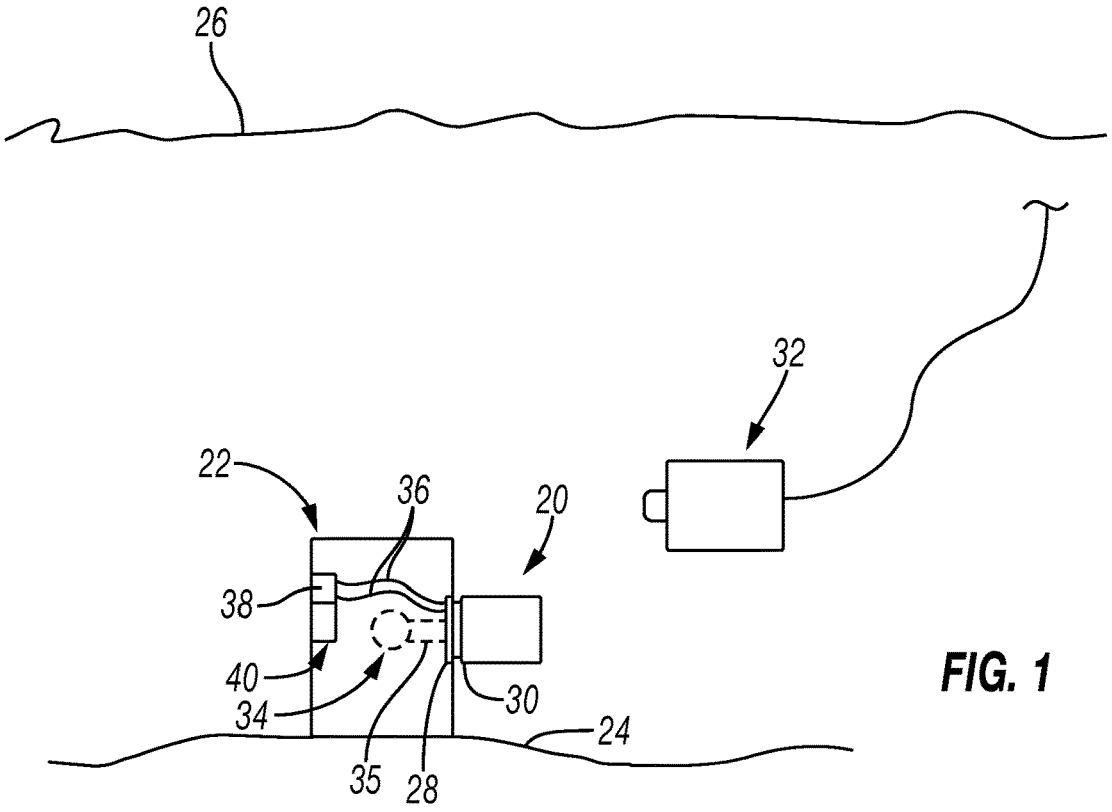
FIG. 1 is a schematic illustration of an example of a subsea electrical actuator combined with a subsea host, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology for coupling an actuator, e.g. a subsea actuator, with a host, e.g. a subsea host, in which mechanical and electrical connections are both formed during movement of the subsea actuator into engagement with the subsea host. Embodiments of the actuator are electrically powered and may be employed in many types of applications, such as resource extraction applications from subsea wells or onshore wells. Using an electrically powered actuator enables actuation without using hydraulic fluid which would otherwise be delivered from a vessel, ship, topside platform, or onshore platform. Consequently, a subsea electrical actuator may be controlled from increased distances and from a suitable vessel, ship, topside platform, onshore platform, or other suitable location. The electric actuator also facilitates operation of valves or other driven components at greater water depths, in harsher environments, and with no risk of hydraulic discharge. It should be noted embodiments of the electric actuator are described as subsea electrical actuators for use in subsea applications, but the electrical actuators also can be used in onshore applications.

In some embodiments, the electrical actuator comprises an electric motor which may be coupled with a drive component, such as a driveshaft. For example, the electric motor or other type of motive member may be coupled with the drive component through an appropriate gear set or gear sets. Electrical power may be supplied to the electrical actuator via a power supply, such as a power supply located inside of a control module. In subsea applications, the control module may be in the form of a subsea control module (SCM). For subsea applications, the electric actuator may be moved into engagement with a corresponding subsea host via a variety of suitable transport mechanisms, such as a remotely operated vehicle (ROV), a mini submarine, a subsea manipulator, a remotely operated tool, a diver, or through other suitable techniques.

According to embodiments described herein, the subsea electrical actuator may be moved to a desired subsea host location. Then, the subsea actuator may be guided into initial mechanical engagement with the subsea host. During movement of the subsea actuator into full mechanical engagement, a drive member and at least one electrical connector of the subsea electrical actuator are operatively coupled with corresponding features of the subsea host. The engagement of the subsea actuator and subsea host may be accomplished with a simple installation motion.

The drive member may comprise a movable stem, e.g. a rotatable driveshaft, or other suitable drive member which may be selectively operated via the electric motor or other type of motive member to actuate a valve or other driven component in the subsea host. According to one embodiment, the subsea electrical actuator comprises an actuator body having a rear face and a front face. At least one electrical connector and a mechanical interface are both positioned along the front face. A guide mechanism, e.g. one or more guide pins, may be used to guide the subsea actuator into engagement with the subsea host.

Depending on the application, the electrical actuator may be used in cooperation with various types of hosts. In subsea applications, for example, the subsea host may comprise a variety of subsea production or processing devices. Examples of such subsea host structures include a subsea tree, manifold, pump, pipeline end manifold (PLEM), pipeline end termination (PLET), or other subsea hosts.

Referring generally to FIG. 1, an example of an electrical actuator 20, e.g. subsea electrical actuator, is illustrated as engaged with a corresponding host 22, e.g. a subsea host. The host 22 may comprise a variety of devices or other host structures such as those described above for subsea applications or surface applications. In the illustrated example, the host 22 is in the form of a subsea host positioned along, for example, a seabed 24 and at a given depth beneath a surface 26. However, the host 22 may be located onshore in some embodiments.

In subsea applications, the subsea electrical actuator 20 and subsea host 22 may be constructed for subsea operation by, for example, using materials resistant to deleterious effects of saltwater. The subsea electrical actuator 20 and subsea host 22 also may be constructed for subsea operation by using suitable seals and housings to provide a sealed, protected environment in which components are protected against undesirable fluids, pressures, and/or other potentially harmful elements that may be found in a subsea environment.

In the embodiment illustrated in FIG. 1, the host 22 comprises a host interface 28 which includes a mechanical interface and an electrical interface. The electrical actuator 20 comprises an actuator interface 30 constructed to operatively engage the host interface 28 when the electrical actuator 20 is moved into engagement with the corresponding host 22. As described in greater detail below, the host interface 28 and the actuator interface 30 are constructed to enable both operative mechanical and electrical engagement as the electrical actuator 20 is moved into engagement with the host 22.

In subsea applications, various mechanisms and techniques may be used to move the electrical actuator 20 into engagement with host 22, as described above. One technique is to utilize an ROV 32 which can be controlled to move the subsea electrical actuator 20 to the subsea host 22 and then to move the electrical actuator 20 into engagement with host 22. By way of example, the interfaces 28, 30 may be constructed to enable both mechanical and electrical coupling of the actuator 20 with the host 22 during linear movement of the actuator 20 toward the host 22 until operatively engaged.

According to the embodiment illustrated, the host 22 comprises a driven component 34 which may be controlled via electrical actuator 20 once the electrical actuator 20 is operatively engaged with host 22. In some examples, the driven component 34 is coupled with actuator 20 via a linkage 35, e.g. a shaft, extending to the host interface 28 for mechanical engagement with the electrical actuator 20. The driven component 34 may comprise a valve, e.g. a choke valve, ball valve, or gate valve, or another driven component selectively moved via electrical actuator 20.

Electrical power may be supplied to electrical actuator 20 via a suitable electrical control line or control lines 36. The control lines 36 may be connected to a power source 38 positioned at a subsea location, surface location, or other suitable location. In some embodiments, the electrical control lines 36 are coupled with a control module 40 and enable transfer of desired electrical signals, e.g. power and data signals. FIG. 1 illustrates one embodiment of the control module 40 in which the control module 40 comprises a subsea control module mounted within subsea host 22 or at another suitable subsea location.

Figure 2:
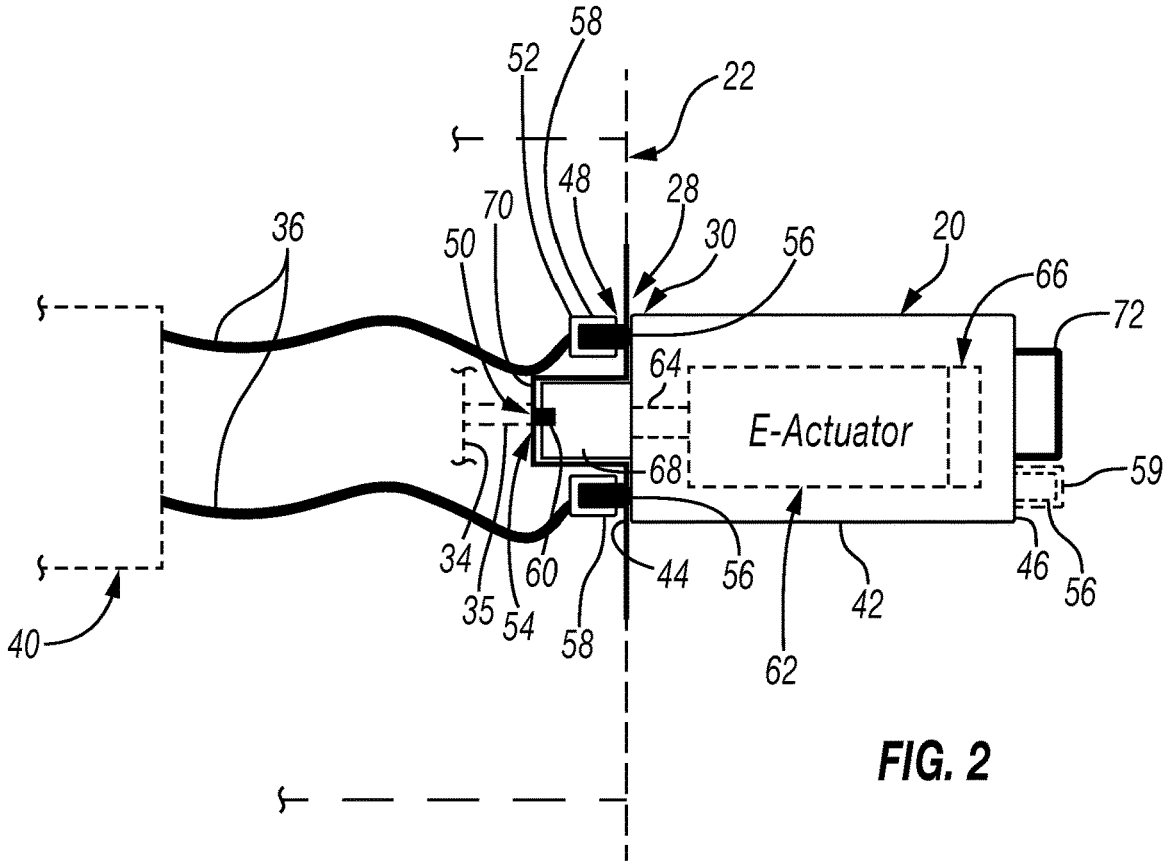
FIG. 2 is a schematic illustration of a subsea electrical actuator, according to an embodiment of the disclosure.

Referring generally to FIG. 2, an embodiment of electrical actuator 20 is illustrated as operatively engaged with the corresponding host 22 via linear coupling of host interface 28 and actuator interface 30. In this example, the electrical actuator 20 comprises an actuator body 42 having a front face 44 and a rear face 46. The interface 30 of electrical actuator 20 comprises an electrical interface 48 and a mechanical interface 50 positioned along the front face 44 to enable both electrical and mechanical connection with the host 22 while the electrical actuator 20 is moved toward and into engagement with host 22. For example, the actuator electrical interface 48 and mechanical interface 50 are constructed for operative engagement with a corresponding host electrical interface 52 and host mechanical interface 54, respectively, during this engaging movement of actuator 20.

By way of example, the actuator electrical interface 48 may comprise at least one electrical connector 56 positioned along front face 44. In the example illustrated, a plurality of the electrical connectors 56 is positioned along front face 44 for electrical engagement with corresponding electrical connectors 58 of host electrical interface 52. By way of example, the electrical connectors 56, 58 may comprise male/female connectors, respectively, or vice versa. In some embodiments, the electrical connectors 56 may be positioned along front face 44 by extending directly from front face 44. However, the connectors 56 also may extend along front face 44 from bases along the side or sides of actuator body 42. For example, the electrical connectors 56 may have elbows allowing them to extend from the sides of actuator body 42 before turning to extend past the front of actuator body 42 along front face 44.

The electrical connectors 56, 58 (e.g. male/female connectors) may be utilized for transmission of desired electrical signals, e.g. electrical power signals, control signals, and data communication signals. In some embodiments, at least one electrical connector 56 may be located along rear face 46 (or another suitable location) as indicated in dashed lines in FIG. 2. This connector(s) 56 can be enclosed with a cover 59 during normal operations. The cover 59 would then be removed to enable use of the rear face connector 56 in the case of a faulty front face connector and/or during intervention.

Various types of electrical connectors 56, 58 and/or related components may be utilized. One example of conductive couplings comprises stab plate connectors. In some applications, the host electrical connectors 58 may be installed at a fixed position on, for example, a panel of the host structure 22 but with a predefined free-floating capability for tolerance compensation. The electrical connectors 56, 58 also may be constructed in the form of inductive couplings able to transmit electrical power and/or data signals.

The actuator mechanical interface 50 may comprise a drive member 60 which automatically engages the driven component 34, e.g. valve, via linkage 35 or other suitable mechanism. In the illustrated embodiment, the linkage 35 extends to and forms part of the host mechanical interface 54. The drive member 60 may be in the form of a drive stem which is linearly or rotatably movable by a motive member 62 within actuator body 42.

By way of example, the motive member 62 may comprise an electric motor powered via electric control lines 36 so as to provide controlled rotation of drive member 60. In some applications, the drive member 60 is in the form of a driveshaft which may be rotated by the motive member/electric motor 62. Depending on the application, the driveshaft or other type of drive member 60 may be coupled with the electric motor 62 via a suitable gear set or gear sets 64. Electrical power and/or data signals may be communicated between the electric motor 62 and the at least one electrical connector 56 via suitable electronics 66.

In some embodiments, the actuator mechanical interface 50 also may comprise a bucket coupling 68 sized and constructed for receipt in a bucket receiver 70 of host mechanical interface 54. For example, the bucket coupling 68 and corresponding bucket receiver 70 may be in the form of ROV bucket couplings and ROV buckets, respectively. For rotary drive members 60, the ROV interface between the ROV bucket coupling 68 and bucket receiver 70 may be constructed with a variety of cooperating configurations, e.g. according to standards described in ISO 13628-8 or API 17H. To facilitate movement and installation of the subsea electrical actuator 20, an ROV grab handle 72 may be fastened to actuator body 42 to enable coupling with ROV 32. The handle 72 facilitates movement of the subsea electrical actuator 20 into and out of engagement with the subsea host 22 via ROV 32.

Depending on the parameters of a given subsea operation, the electric control lines 36 may be part of an electrical flying lead (EFL) connected between subsea control module 40 and host electrical connectors 58. Additionally, actuator electrical connectors 56 and corresponding host electrical connectors 58 may be constructed as wet-mate connectors to facilitate coupling and decoupling in a liquid environment with simple linear motion of the electrical actuator 20. The installation and de-installation of the electrical actuator 20 with respect to the host 22 may be accomplished without a live electrical connection, i.e. without electrical power supplied to the electrical actuator 20 during engagement and disengagement with respect to host 22.

Figure 3:
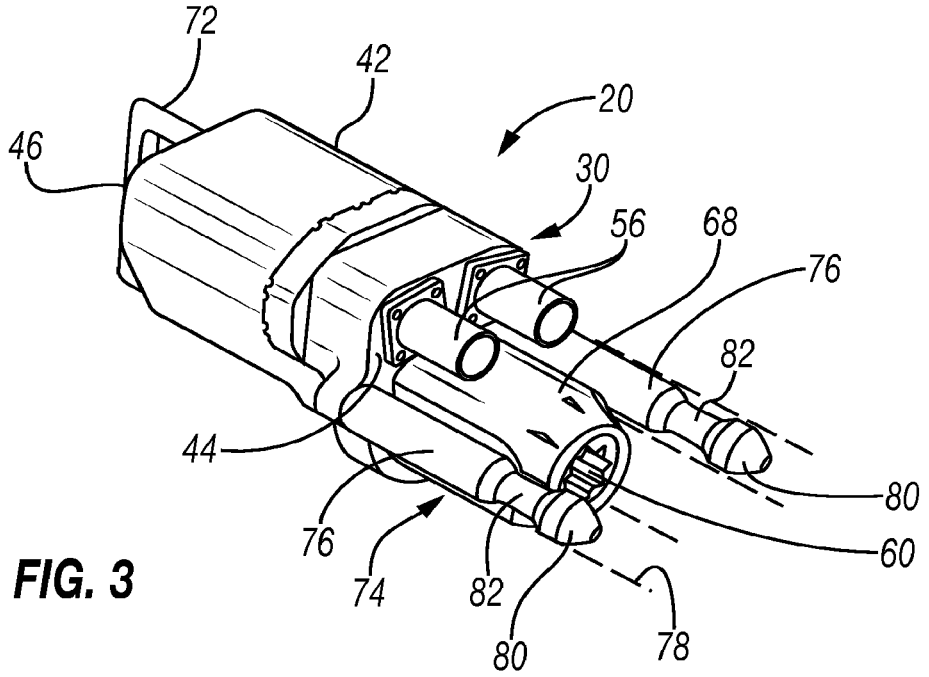
FIG. 3 is an orthogonal view of an example of a subsea electrical actuator having a rotary drive member, e.g. driveshaft, according to an embodiment of the disclosure.

Referring generally to FIG. 3, an embodiment of the electrical actuator 20 is illustrated. In this embodiment, the electrical actuator 20 comprises a guide mechanism 74 constructed to facilitate a desired alignment, centering, and/or locking of the electrical actuator 20 with respect to the corresponding host 22. According to one example, the guide mechanism 74 comprises at least one guide pin 76, e.g. a plurality of guide pins 76. The guide pins 76 engage corresponding pin receiving recesses 78 which may be formed by corresponding bushings, bores, or other suitable recesses which receive the guide pins 76. The interaction between pins 76 and recesses 78 serves to properly orient and align the electrical actuator 20 with the host 22. Proper alignment ensures the desired electrical and mechanical coupling as the electrical actuator 20 is moved into engagement with host 22. It should be noted the guide pins 76 can be mounted on host 22 and the corresponding recesses 78 formed in electrical actuator 20.

In some embodiments, each guide pin or pins 76 includes a lead tapered surface 80, e.g. a chamfered surface, to facilitate entry into the pin receiving recesses 78 and to facilitate alignment of actuator 20 and host 22. The guide mechanism 74, e.g. guide pins 76, also may comprise a locking mechanism 82. The locking mechanism 82 may have various constructions for preventing unwanted separation of the electrical actuator 20 from the host 22 after the combined mechanical and electrical engagement.

During the process of forming a mating engagement between electrical actuator 20 and corresponding host 22, the lead tapered surface 80 of each guide pin 76 serves to properly align the actuator interface 30 with the host interface 28 as the electrical actuator 20 is moved linearly toward host 22. The guide pins 76 enable this proper alignment prior to forming the operative mechanical and electrical coupling between the actuator interface 30 and host interface 28. Additionally, the guide mechanism 74, e.g. guide pins 76, may be constructed to absorb forces during operation of the retrievable electric actuator 20. For example, the guide pins 76 may be used to prevent undue torsion forces or other lateral forces on the electrical connectors 56. The locking mechanism 82, e.g. a groove for receiving a spring-loaded dog, may be constructed to maintain the retrievable electrical actuator 20 in place, e.g. to prevent self or uncontrolled disconnection of the actuator 20 from host 22. Locking mechanism 82 also may be used to limit undesired relative movement between the actuator 20 and the host 22 during operation of the electrical actuator 20.

Figure 4:
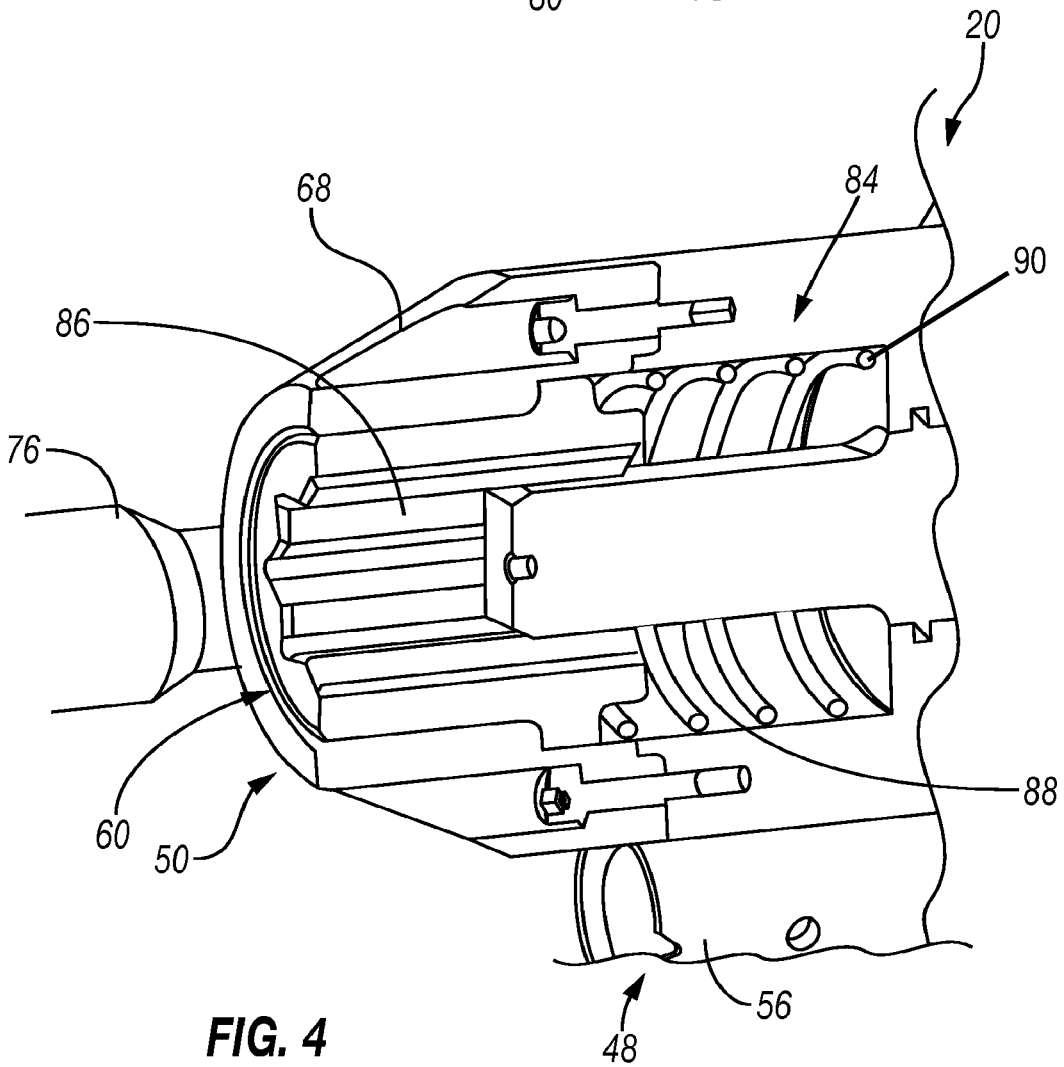
FIG. 4 is a cross-sectional illustration of a portion of a subsea electrical actuator showing an example of a mechanical coupler, according to an embodiment of the disclosure.

In some embodiments, mechanical coupling of the electrical actuator 20 with the corresponding host 22 may be facilitated by providing a spring-loaded link 84 between actuator mechanical interface 50 and host mechanical interface 54. In the embodiment illustrated in FIG. 4, the spring-loaded link 84 may be part of the drive member 60. By way of example, a coupling 86 may be slidably mounted along a driveshaft portion 88 of drive member 60.

As illustrated, the coupling 86 is biased via a spring 90 in a direction toward the host mechanical interface 54 during engagement of electrical actuator 20 with host 22. By way of example, the coupling 86 may be in the form of a rotatable socket having an interior configuration constructed for engagement with, for example, linkage 35 so as to enable rotation of the desired valve or other driven component 34.

The spring-loaded coupling 86 facilitates mechanical engagement of the electrical actuator 20 with the host 22 by allowing the coupling 86 to be pushed back during the mating process. As the actuator 20 is moved linearly toward host 22, for example, the movable coupling 86 enables the operative engagement to occur even if coupling 86 and linkage 35 are initially rotationally misaligned. Once the drive member 60 is rotated via motive unit/electric motor 62, the internal configuration of the coupling 86 aligns with the corresponding configuration of, for example, linkage 35. The spring 90 is then able to move the coupling 86 into a position for applying torque to linkage 35.

It should be noted the components forming the operational mechanical coupling between electrical actuator 20 and host 22 may have a variety of male/female configurations or other configurations to effectively form an operational mechanical coupling between the drive member 60 and the driven component 34. The mechanical coupling forms the mechanical link which allows operation of motive unit/electric motor 62 to drive the driven component 34, e.g. valve, to desired operational positions. If drive member 60 is a rotational member, for example, mechanical coupling 86 may be used to position the drive member 60 in operative mechanical engagement with host mechanical interface 54 such that rotation of drive member 60 allows coupling 86 to slide so that torque may be applied to linkage 35.

The embodiments described herein may be employed in a variety of subsea operations. However, the pluggable and retrievable electrical actuator 20 also may be employed in various surface applications with surface-based host structures. In subsea applications, the electrical actuator 20 may be constructed in various sizes and configurations for retrievable engagement with subsea hosts 22 having various host structures. By way of example, the subsea host 22 may comprise a subsea tree, manifold, pump, PLEM, PLET, or other suitable subsea host.

Furthermore, the electrical actuator 20 may comprise several types of components arranged in various configurations. For example, actuator body 42 may have various sizes and configurations; and the internal motive unit 62 may be in the form of an electric motor or other suitable motive unit. The motive unit 62 is powered electrically and able to provide a desired motion, e.g. a rotational motion, to the drive member 60. Similarly, the electrical and mechanical interfaces of both the electrical actuator 20 and corresponding host 22 may have various configurations which facilitate operative engagement of the electrical actuator 20 with the corresponding host 22 via a simple movement of the electrical actuator 20.

In some embodiments, for example, the electrical actuator 20 may comprise a plurality of actuators 20 formed with a plurality of actuator bodies 42 and/or motive units 62. In this type of embodiment, the plurality of actuators 20 can be assembled on a panel and the mechanical guide mechanism 74, e.g. guide pins 76, may be connected to the panel. The various electrical connectors 56 and mechanical interfaces 50 can thus be guided into corresponding features of the host 22. Such an embodiment may be used to, for example, actuate a plurality of driven components 34 located in the host 22

As described above, operative electrical and mechanical engagement for actuating driven component 34 can both be established as the electrical actuator 20 is moved toward the corresponding host 22. For example, the guide mechanism 74 may be used to establish the initial mechanical engagement between the electrical actuator 20 and the corresponding host 22. The drive member 60 and electrical connectors 56 of the electrical actuator 20 may then be operatively coupled with the corresponding components of the host 22 as the electrical actuator 20 is guided into full engagement with the host 22.

Placement of the electrical interface 48 and mechanical interface 50 along front face 44 of electrical actuator 20 is one technique for facilitating electrical and mechanical engagement with the host 22 via simple movement of electrical actuator 20 toward host 22. However, other components and arrangements of components may be utilized in the electrical actuator 20 and in the corresponding host 22 to facilitate coupling and decoupling. The electrical power and/or control commands also may be provided from various types of control modules or other sources disposed at suitable locations.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a subsea operation, comprising:

a subsea electrical actuator selectively engageable with a host interface of a subsea host, the subsea electrical actuator comprising:

an actuator body having a rear face and a front face;

at least one conductive electrical connector that is coupled to and extends from the front face;

a mechanical interface that is coupled to and extends from the front face, the mechanical interface configured to move a driven component of the subsea host upon engagement of the subsea electrical actuator with the subsea host; and a guide mechanism configured to guide the at least one conductive electrical connector and the mechanical interface into engagement with corresponding features of the host interface during engagement of the subsea electrical actuator with the subsea host, wherein the guide mechanism is coupled to and extends from the front face.

2. The system as recited in claim 1, wherein the at least one electrical connector is a wet-mate connector.

3. The system as recited in claim 1, wherein the at least one electrical connector comprises a plurality of electrical connectors.

4. The system as recited in claim 1, wherein the mechanical interface comprises a drive stem.

5. The system as recited in claim 4, wherein the drive stem comprises a driveshaft rotatable relative to the actuator body.

6. The system as recited in claim 5, wherein the driveshaft is driven by an electric motor within the actuator body.

7. The system as recited in claim 6, wherein the mechanical interface is a bucket coupling.

8. The system as recited in claim 7, wherein the drive stem comprises a coupler spring biased to facilitate application of torque by the driveshaft.

9. The system as recited in claim 1, wherein the guide mechanism comprises at least one guide pin.

10. A system for use in a subsea operation, comprising:

a subsea electrical actuator selectively engageable with a host interface of a subsea host, the subsea electrical actuator comprising:

an electrical connector configured to couple to the host interface;

a mechanical interface configured to mechanically couple an electric motor to a driven component of the subsea host, the mechanical interface defining an end face, the mechanical interface comprising:

a drive shaft, the drive shaft is configured to couple to the electric motor, a coupling coupled to the drive shaft and configured to couple to the host interface, wherein the coupling is configured to move axially relative to the drive shaft; and a guide mechanism configured to guide the electrical connector and the mechanical interface into engagement with the host interface, wherein the guide mechanism extends beyond the end face of the mechanical interface along a longitudinal axis of the mechanical interface.

11. The system as recited in claim 10, wherein the electrical connector is a wet-mate connector.

12. The system as recited in claim 11, wherein the electrical connector comprises inductive couplings for transmission of power and data.

13. The system as recited in claim 10, wherein the mechanical interface is a bucket coupling.

14. The system as recited in claim 10, comprising a spring configured to bias the coupling toward the host interface.

15. The system as recited in claim 10, wherein the guide mechanism comprises at least one guide pin.

16. The system as recited in claim 10, wherein the subsea electrical actuator comprises a remotely operated vehicle (ROV) grab handle.

17. The system as recited in claim 10, wherein the driven component comprises a valve.

18. The system as recited in claim 10, comprising the subsea host.

19. The system as recited in claim 18, wherein the subsea host comprises a control module and a power source.

* * * * *